US006322034B1

(12) United States Patent
O'Malley

(10) Patent No.: US 6,322,034 B1
(45) Date of Patent: Nov. 27, 2001

(54) HIGH STORAGE DENSITY ROLL STOCK STACKING SUPPORT

(76) Inventor: Joseph O'Malley, 251 W. Taylor Rd., Selah, WA (US) 98942

( * ) Notice: Subject to any disclaimer, the term of this patent is extended or adjusted under 35 U.S.C. 154(b) by 0 days.

(21) Appl. No.: 09/613,652

(22) Filed: Jul. 11, 2000

Related U.S. Application Data

(63) Continuation-in-part of application No. 09/330,536, filed on Jun. 11, 1999, now Pat. No. 6,209,839.

(51) Int. Cl.[7] ..... B65D 19/00
(52) U.S. Cl. ..... 248/346.02; 248/68.1
(58) Field of Search ..... 248/346.01, 346.02, 248/68.1; 211/594; 206/395, 597, 419

(56) References Cited

U.S. PATENT DOCUMENTS

| | | | |
|---|---|---|---|
| D. 345,845 | 4/1994 | Strzegowski, Jr. | D34/38 |
| D. 381,180 | 7/1997 | Schueneman et al. | D34/38 |
| D. 384,481 | 9/1997 | Sheckells | D34/38 |
| D. 385,080 | 10/1997 | Schueneman et al. | D34/38 |
| D. 400,441 | 11/1998 | Warren | D9/456 |
| D. 403,961 | 1/1999 | Warren | D9/456 |
| D. 408,737 | 4/1999 | Warren, Jr. | D9/456 |
| 2,766,660 | 10/1956 | Laddon et al. | 89/1.5 |
| 3,837,560 | 9/1974 | Kuchuris et al. | 229/15 |
| 4,195,732 | 4/1980 | Bell | 206/391 |
| 4,240,557 | 12/1980 | Dickens | 211/153 |
| 4,378,923 | 4/1983 | Takei | 248/68 R |
| 4,435,463 | 3/1984 | Roellchen | 428/158 |
| 4,610,362 | 9/1986 | Remp et al. | 211/59.4 |
| 4,705,170 | 11/1987 | Creaden | 206/419 |
| 4,792,045 | 12/1988 | Creaden | 206/419 |
| 4,832,196 | 5/1989 | Butler | 206/391 |
| 4,901,870 | 2/1990 | Wright et al. | 211/59.4 |
| 4,936,453 | 6/1990 | Knitter | 206/419 |
| 5,080,314 | 1/1992 | Moyer et al. | 248/346 |
| 5,100,076 | 3/1992 | Cobane et al. | 242/71.8 |
| 5,123,547 | 6/1992 | Koch | 211/59.4 |
| 5,161,703 | 11/1992 | Patton | 211/294 |
| 5,381,898 | 1/1995 | Jones | 206/391 |
| 5,415,286 | 5/1995 | Marchek et al. | 206/330 |
| 5,421,537 | 6/1995 | Cobane et al. | 242/614 |
| 5,433,322 | 7/1995 | Williams | 206/443 |
| 5,499,716 | 3/1996 | Gardner | 206/553 |
| 5,649,632 | 7/1997 | Terashima et al. | 211/59.4 |
| 5,755,541 | 5/1998 | Suarez | 410/36 |
| 5,829,592 | 11/1998 | Henry, Jr. et al. | 206/416 |
| 5,873,460 | 2/1999 | Reinhardt | 206/321 |
| 5,899,331 | 5/1999 | Warren, Jr. | 206/443 |
| 5,934,467 | 8/1999 | Gilfert et al. | 206/391 |
| 5,960,954 | 10/1999 | Seybold | 206/389 |

*Primary Examiner*—Ramon O. Ramirez
(74) *Attorney, Agent, or Firm*—R. Reams Goodloe, Jr.

(57) ABSTRACT

A support for receiving and supporting stacked tiers of cylindrical roll stock is provided. The support can be either located on the base tier of the rolls, folded between tiers, or placed on the top tier, all to provide a rectangular stacked arrangement of the roll stock that is especially suited for storage or transport. The roll support includes a support body that is preferably formed from a resinous plastic, polymeric material, such as PET that includes a plurality of curved cradles and each curved cradle is sized for receiving a roll of cylindrical stock. A multiple of the support bodies combine to support a multiple of the rolls of cylindrical stock in a tiered array. Each support body can substantially support the weight of each roll of cylindrical stock received within its curved cradles. The weight of the support body is less than the supported weight of the roll of cylindrical stock. Additionally, the support can nest together in storage, with a minimum of increase in the nested stack height, when roll supports are added to the stack.

15 Claims, 8 Drawing Sheets

HIGH STORAGE DENSITY ROLL STOCK STACKING SUPPORT

This application is a Continuation-In-Part of prior application Ser. No. 09/330,536, filed Jun. 11, 1999, now U.S. Pat. No. 6,209,839 the disclosure of which is incorporated herein in its entirety by this reference.

TECHNICAL FIELD

The invention relates to stacking supports for roll stock, and more particularly to a compactly nestable, high strength, improved stacking support for roll stock.

BACKGROUND

"Roll stock" is a term that is commonly used to describe cylindrical rolls or tubular rolls of a selected width of thin materials. Such items include paper products, plastic film products, thin gauge metals, roofing sheets, and various other thin materials. Importantly, these various cylindrical or tubular shaped rolls are typically shipped and stored on pallets. Most often, such storage is provided in tiers of rolls, and, most commonly, the rolls are horizontally oriented above the pallets. In order to stabilize and support the cylindrical or tubular rolls, stacking supports have typically been employed.

Various U.S. patents show stacking supports for receiving stacked rolls of materials. One such disclosure is found in U.S. Pat. No. 4,195,732 to Bell, which teaches a support and spacing member for roll stock formed from expanded polystyrene foam. Similarly, U.S. Pat. No. 4,832,196 to Butler shows a roll support member that, like Bell the '732 patent, is formed utilizing expanded polystyrene foam. However, certain characteristics of the polystyrene foam make it less than ideal for use in roll stock supports. This is because expanded polystyrene is rather rigid, relatively brittle, and thus has a minimum of structural flexibility. Additionally, polystyrene foam rolls supports do not compactly nest together and thus storage of roll supports manufactured of polystyrene or similar plastic materials takes up considerable space.

One alternative to polystyrene foam roll supports has been the development and use of roll supports made from papier-mâché. For example, U.S. Pat. No. 5,080,314 issued Jan. 14, 1992 to Moyer et al for a ROLL STACKER teaches a roll support formed of papier-mâché. Unfortunately, in many circumstances, papier-mâché is inadequate for roll stock supports. For example, the strength of papier-mâché roll stock supports rapidly degrades which they get wet. Consequently, papier-mâché roll sock supports must be protected from the weather, and even cannot be used in many humid environments. Such weather protection is especially difficult during transport, and requires that such supports be shipped within a fully enclosed container or trailer.

Further, even though roll supports manufactured from papier-mâché have improved stackability over foam type roll supports, because papier-mâché roll stackers must be of substantial thickness to support the weight of many materials, it would nevertheless be desirable to develop a material that would further reduce the storage space requirements of roll supports, to free up warehouse space. Thus, there remains a need for a strong, weather-proof, preferably recyclable material which can be utilized in the production of compactly stackable roll supports which can be stored with minimal warehouse volume requirements.

SUMMARY

I have now developed a roll stacking support that can be fabricated in a high strength material suitable for high density storage of the roll stacking support, especially when compared to storage density of conventional stacking supports manufactured from foam or from molded pulp utilizing prior art roll support designs. Importantly, certain improved structural components of my roll stacking support design may be utilized to advantage in improving the performance of prior art roll supports made of materials such as papier-mâché.

My novel roll support design provides a support for receiving and supporting stacked tiers of roll stock. My roll support is designed for use in roll support pairs, so that the pair of roll supports can be folded out and utilized side-to-side and located below a base tier of roll stock, or so that the pair of roll supports can be used in a back-to-back fashion and located between tiers or roll stock, or folded out in a side-by-side orientation and placed above a top tier of roll stock, all in order to provide a secure, stacked arrangement of the roll stock that is suited for storage or transport. Alternately, as single one of a pair can be used where appropriate at the base or at the top of a stack of roll stock. Importantly, successive pair sets of my roll supports in pile of such roll supports will nest tightly within a prior or lower pair set, thereby substantially reducing the storage space required for new or for used roll supports. It is preferable (but not mandatory) that roll supports provided utilizing my design configurations be thermoformed utilizing a recyclable plastic. To date, the most preferable structural material that I have found is the use of the polyethylene terephthalate (PET) type plastic.

My roll support is preferably formed and provided in a side-by-side pair of support portions which are attached to each other along a flexible joint or hinge. Each roll support portion includes an elongated upper surface having a plurality of roll support cradle portions. Each of the roll support cradle portions has an outward surface shaped in an arcuate segment of pre-selected dimensions adapted for securely receiving a piece of roll stock of substantially complementary shape. A pair of longitudinally running opposing sidewall portions is provided in each roll support portion, and each of the opposing sidewall portions slope inwardly and upwardly toward the elongated upper surface. A base is provided in each of the roll support portions. The base provides upward structural support to each of the opposing sidewall portions, which, in turn, each provide upward structural support for the upper surface that has therein a plurality of roll support cradle portions.

For enhanced structural strength, I provide one or more support platforms, and preferably two support platforms, in each of the roll support cradle portions. The support platforms each have first and second inwardly and downwardly sloping sidewall portions, and each of the sloping sidewall portions have a lower end portion. A transversely extending bottom support foot is provided at the lower reaches of the support platforms. The bottom support foot located adjacent to the lower end portion of the first and second inwardly and downwardly sloping sidewall portions, and the bottom support foot extends laterally across at least a portion of the roll support cradle portion. To assure structural strength, the bottom support foot extends downwardly to a location substantially even with said the base of the roll support portion. Also, the roll support cradle portions each have a bottom portion that is preferably elevated above the base of the respective roll support portion.

To enhance compact nestability, I have found it advantageous to provide the opposing sidewall portions angled inward about 20 degrees from the vertical line perpendicular to the base of the roll support. Likewise, to enhance compact nestability, I have found it advantageous to provide inwardly and downwardly sloping sidewalls of the support platforms at angles of about 20 degrees from the vertical line perpendicular to the bottom support foot.

My roll support is configured to receive and support horizontally stacked tiers of roll stock. The cradle surface is sized for receiving a preselected diameter of roll stock. The roll support functions to stabilize the tiered array of roll stock, usually located on a shipping pallet. A multiple of the roll supports are utilized to support a plurality of rolls of roll stock. Firstly, selected rolls of roll stock are supported by a lower tier of roll supports, to form a bottom tier of supported roll stock. The bottom tier of the supported roll stock then supports a plurality of roll supports oriented in a back-to-back configuration, which then supports yet an additional tier of roll stock. Each of the additional tiers of the roll stock is supported by additional roll supports.

Each roll support is structurally able to support distributed portion of the weight of the roll stock that is received within its roll support cradle portions. Thus, my strong roll support design is an important improvement in roll supports for roll stock materials.

BRIEF DESCRIPTION OF THE DRAWING

The invention will be better understood by reference to the following detailed description taken in conjunction with the accompanying drawing, wherein.

DETAILED DESCRIPTION

Figure 1:
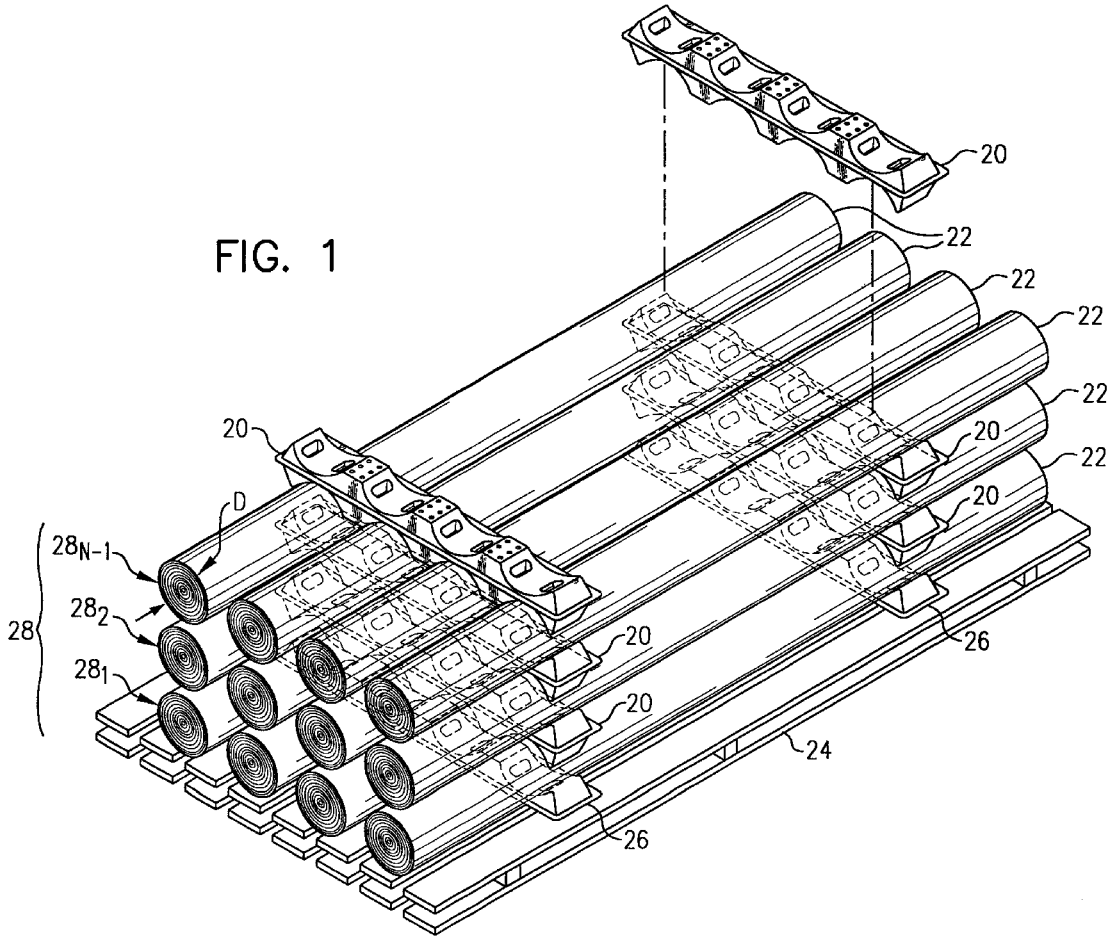
FIG. 1 is a perspective view of a plurality of roll supports, shown in working arrangement to support a stack of roll stock, above a shipping pallet.

Attention is now directed to FIG. 1, wherein one embodiment of my novel roll support 20 is illustrated as used to provide spacing and support to a number of pieces of roll stock 22 situated on a pallet 24. As illustrated in FIG. 1, the roll support 20 is preferably provided in pairs in a back-to-back configuration. However, a single roll support 26 can be utilized if desired below the lowest layer $\mathbf{28}_1$ of layers 28 of roll stock 22 above pallet 24. Then, a back-to-back pair of roll supports 22 can be used between lower layer $\mathbf{28}_1$ and the next layer $\mathbf{28}_2$, and so on up to the Nth or upper layer $\mathbf{28}_N$ in a series of layers $\mathbf{28}_1$ through $\mathbf{28}_N$, although here, only the next to last layer, layer $\mathbf{28}_{N-1}$ is shown.

Preferably, my roll supports 20 are manufactured in pairs $\mathbf{20}_A$ and $\mathbf{20}^B$ which are flexibly joined or "hinged" along adjacent edge portions 34 and 36 of the respective base portions 38 and 40 of pairs $\mathbf{20}_A$ and $\mathbf{20}_B$. Ideally, the flexible joint 42 is formed by thinning the material of construction and allowing only a thin portion of material to connect the pairs $\mathbf{20}_A$ and $\mathbf{20}_B$, or, by allowing only longitudinally successive thin transverse strips to connect the adjoining sections $\mathbf{20}_A$ and $\mathbf{20}_B$ of the roll support pair 20.

Note that reference arrow 50 shows how a first one $\mathbf{20}_A$ of the pair of roll supports is folded under the second one $\mathbf{20}_B$ of the pair of roll supports, to transform the pair from a side-by-side configuration to a back-to-back configuration. In this manner, a first alignment lock 52 in first roll support section $\mathbf{20}_A$ is folded over in close fitting interlocking fashion with a second alignment lock 54 in second roll support section $\mathbf{20}_B$. The pair of alignment locks 52 and 54, when configured as mating dimples as shown here and as further illustrated in FIG. 4, allow registration of a pair of roll support sections $\mathbf{20}_A$ and $\mathbf{20}_B$ even if such sections become disconnected along joint 42 during continued use of the roll support 20.

Figure 5:
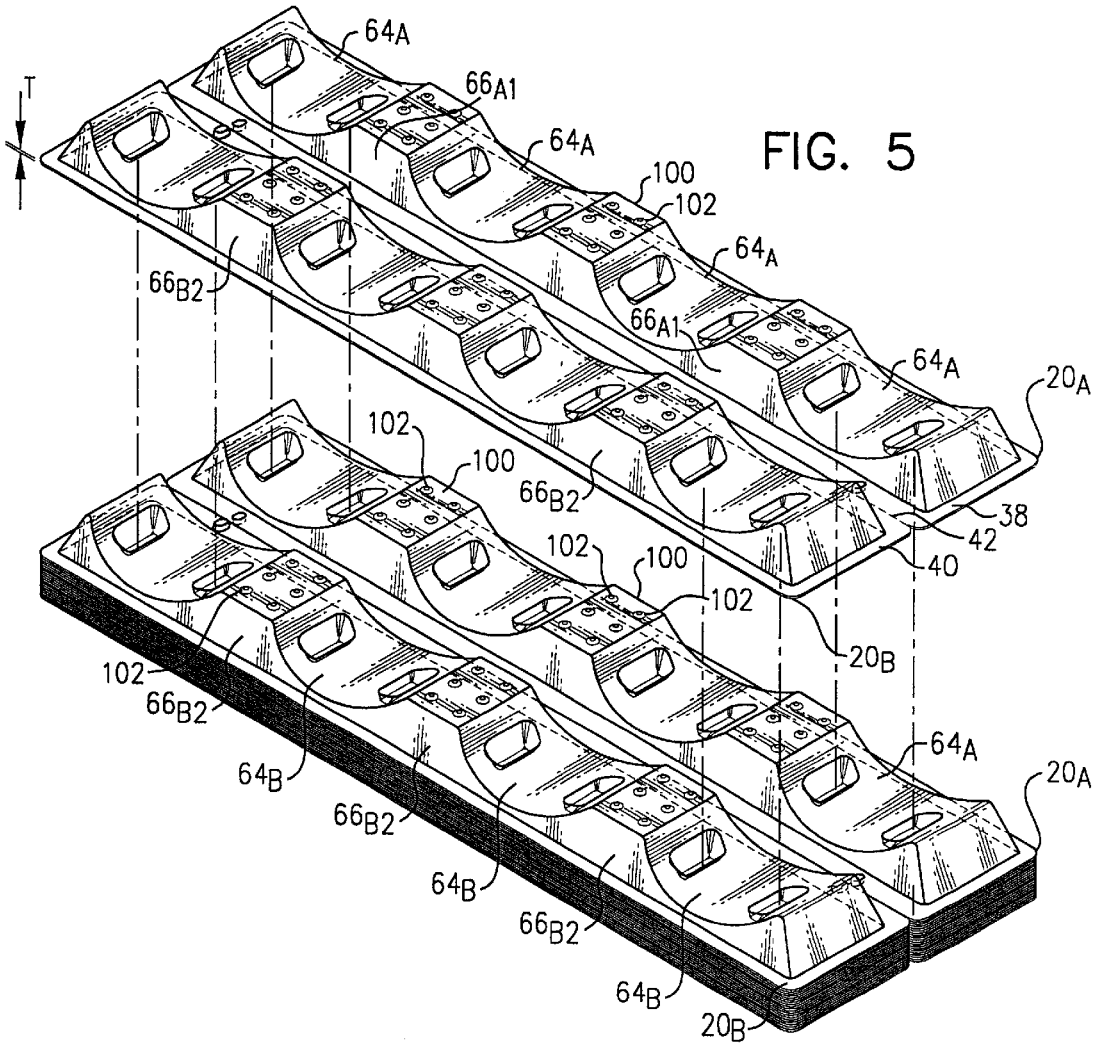
FIG. 5 is a perspective view, which shows pairs of roll supports as nested and stacked for shipping and storage.

As further illustrated in FIG. 5, the compact, side-by-side design of my roll support 20 in hinged pairs $\mathbf{20}_A$ and $\mathbf{20}_B$ allows for compact nesting and compact storage. Preferably, in order to take maximum advantage of this feature, my roll supports are manufactured from a resinous plastic, polymeric material. Preferably, the resinous plastic utilized for the roll support is a high-density polymer that produces a strong, yet flexible final product. I prefer the use of a resinous plastic polymer material is thermoformed to the desired final shape. I have found it desirable to utilize a polyethylene terephthalate material, commonly know by the abbreviation "PET". Importantly, instead of providing a cushioning and flexible support, as would be desired when protecting a fragile article such as glass, my supports for roll stock must be strong and resistant to deformation. This is an ideal application for PET, since PET resin forms a high strength product with good strength in all directions. More preferably, my roll supports 20 are fabricated from recycled plastic materials. Utilizing recycled plastic material is a great advantage over most prior art cellulose materials that are considered more difficult to manufacture from recycled waste products. Recycled plastics are relatively easy to reprocess. PET, as with a great variety of plastic materials, is initially segregated at time of disposal, after which it is typically kept clean and uniform during the entire recycling process, thereby substantially retaining desirable material properties.

Another important property which is achieved by the use of PET is that my paired roll supports 20 can easily stack over a previous pair with only a slight increase in height. As shown in FIG. 5, the thickness T of the roll support of the present invention is only from approximately 40 Mils to approximately 60 mils (or from about 0.04 inches to about 0.06 inches), and is most preferably at the lower end of this thickness range. This very small thickness, when nested, is a significant advantage over the stacked pairs of prior art papier-mâché material, since papier-mâché material prohibits such a close nested stacking of new or used roll supports. For example, I have found about an eight to one advantage in stacking of my PET roll supports over those fabricated in prior art papier-mâché materials. In one test, I found that I can stack 1280 of my roll supports 20 in the same vertical height in which only about 160 prior art papier-mâché roll supports will occupy. For another measure of this improved efficiency, I have found that about 960 prior art papier-mâché roll supports will occupy, volumetrically, roughly six times the warehouse volume of that which is occupied by 1280 of my roll supports 20. Moreover, I have found that about 1280 of my roll supports 20 occupy, volumetrically, roughly 12 times the warehouse volume of that occupied by prior art polystyrene foam roll supports. Thus, the nesting compactness of the present invention provides a substantial and significant savings in shipping and storage space, as compared to prior art papier-mâché or foam materials. Thus, it is important to note that warehouse space saved in the storage of my nested and still unused roll supports can be allotted to other storage needs. Alternatively, the saved storage or shipping space can be used to store or transport additional roll supports and allow the purchase of higher quantities to realize bulk rate cost savings and substantially reduce freight costs.

Figure 2:
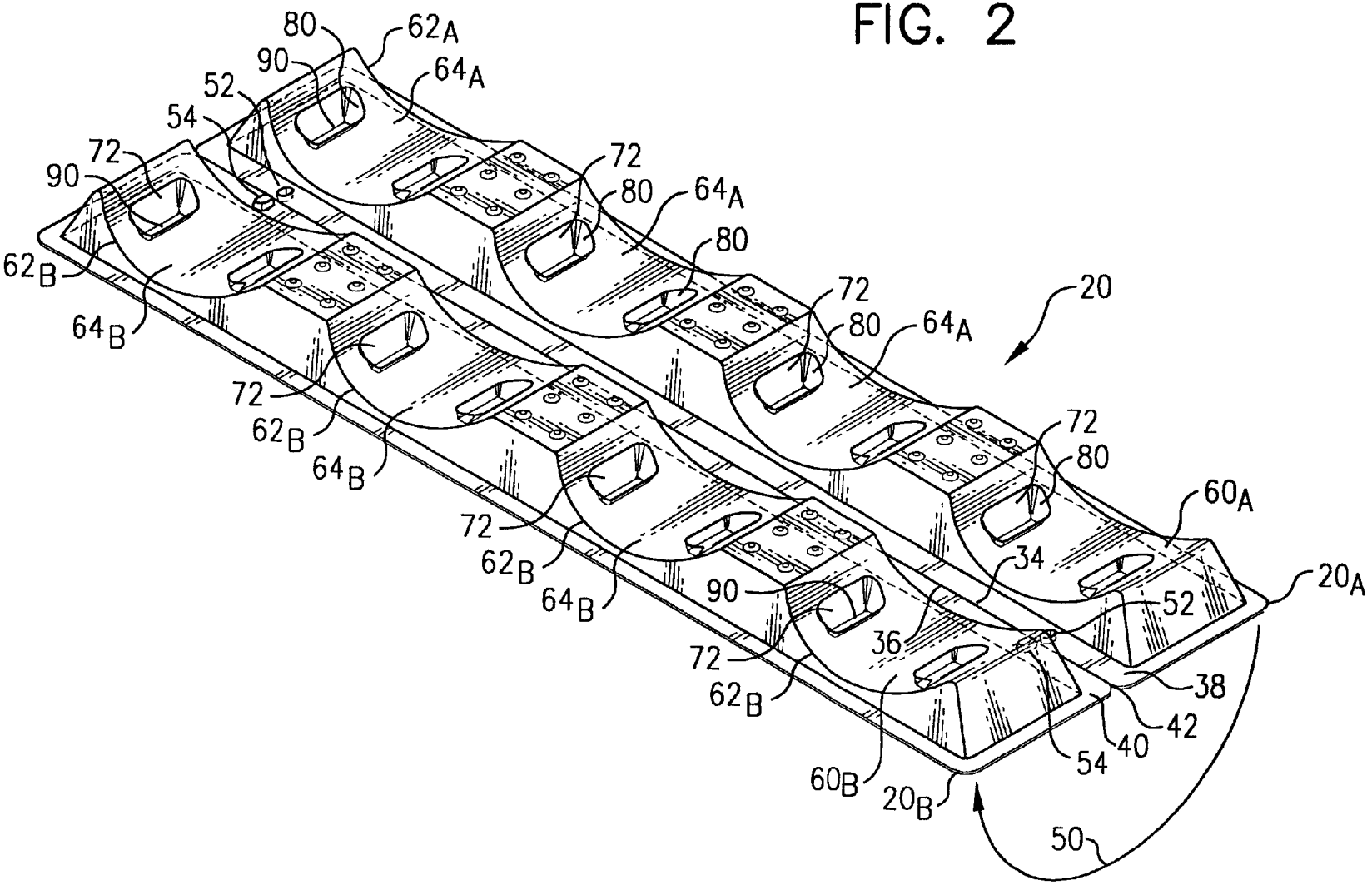
FIG. 2 is a perspective view of a pair of roll supports situated side-by-side, showing how one of the pair of supports may be folded under the other to provide a back-to-back pair of roll supports.
Figure 3:
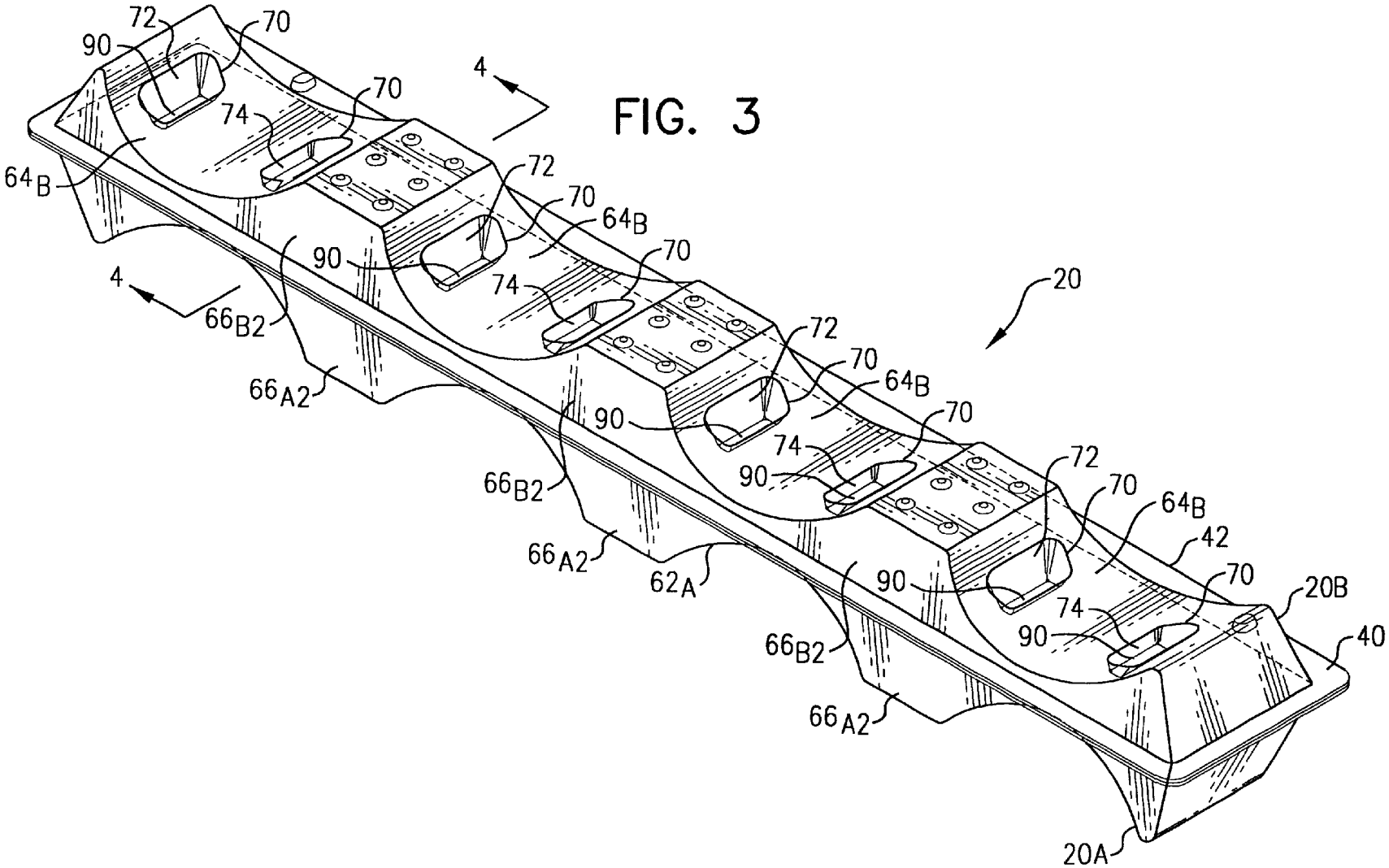
FIG. 3 is a perspective view of a pair of roll supports situated back-to-back, for use in stacking roll stock as shown in FIG. 1 above.
Figure 4:
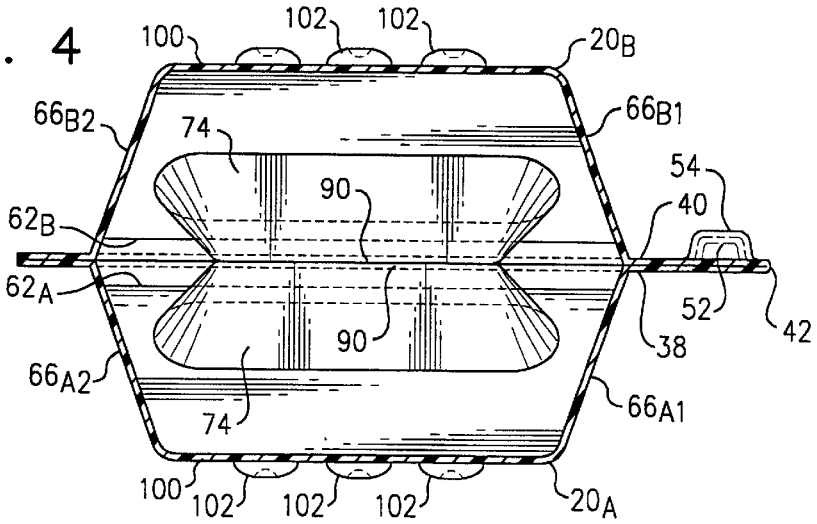
FIG. 4 is a vertical cross sectional view, taken as through line 4—4 of FIG. 3, illustrating the transversely oriented support platforms as well as the alignment locks utilized to register each one of a pair of roll supports to the other in the event that they become disconnected at the flexible hinge between their respective base members.

As earlier described in conjunction with FIGS. 2 and 4 above, each member $\mathbf{20}_A$ and $\mathbf{20}_B$ of the pair of roll supports 20 is preferably joined to the other in a flexible, foldable edge hinge 42 that provides the connected pair $\mathbf{20}_A$ and $\mathbf{20}_B$ with the ability to fold together and form a back-to-back support configuration as shown in FIGS. 3 and 4. Additionally, the flexible hinge 42 can be utilized as a separation edge, for detaching the pair $\mathbf{20}_A$ and $\mathbf{20}_B$ from each other and forming two separate, detached roll supports portions, as noted in conjunction with the discussion of FIG. 1 above.

My roll support portions 20A and 20B, or taken together as a joined roll support 20, are suited for receiving and supporting one or more pieces of roll stock of a selected diameter D and radius R. Each of the roll support portions 20A and 20B have a first elongated upper surface 60A and 60B, respectively, each having a plurality of roll support cradle portions 62A or 62B thereon. Each of the roll support cradle portions 62A and 62B have an outward surface 64A or 64B shaped in an arcuate segment of pre-selected dimensions adapted for securely receiving a piece of roll stock 22 of substantially complementary shape, i.e., preferably complementary diameter D or radius R. To support the roll support cradle portions 62A and 62B, a pair of longitudinally running opposing sidewall portions 66A1 and 66A2, and 66B1 and 66B2 are provided in each of portions 20A and 20B, respectively. When viewed in the side-by-side configuration (see FIG. 5, for example), each of the opposing sidewall portions (66A1, 66A2, 66B1, 66B2) slope inwardly and upwardly toward the first elongated upper surface 60A or 60B, respectively. Each of portions 20A and 20B have a base, 38 and 40, respectively, each of which provides structural support to the adjacent opposing sidewall portions (66A1, 66A2, 66B1, 66B2, as applicable). These opposing sidewall portions, in turn, each provide structural support for the applicable first upper surface (60A or 60B) having thereon a plurality of roll support cradle portions 64A or 64B.

Figure 6:
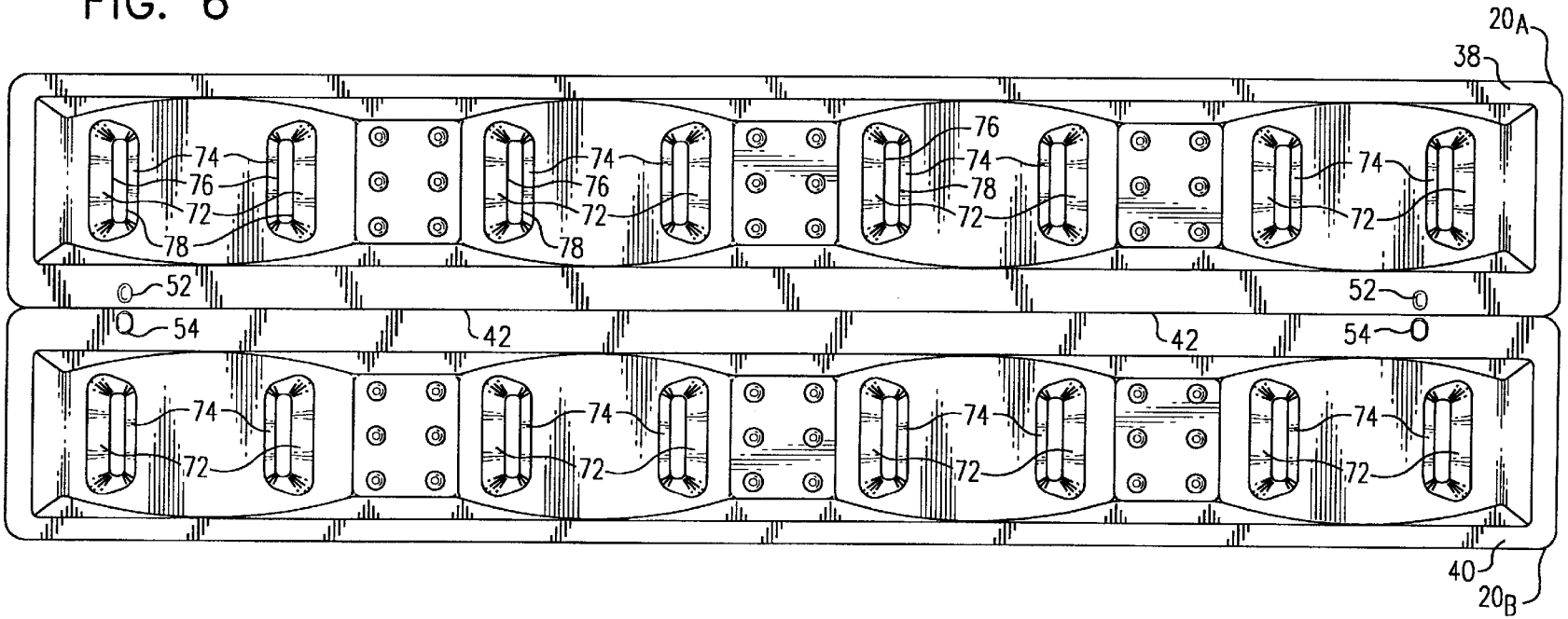
FIG. 6 is a top plan view, taken looking downward on a pair of roll supports.
Figure 7:
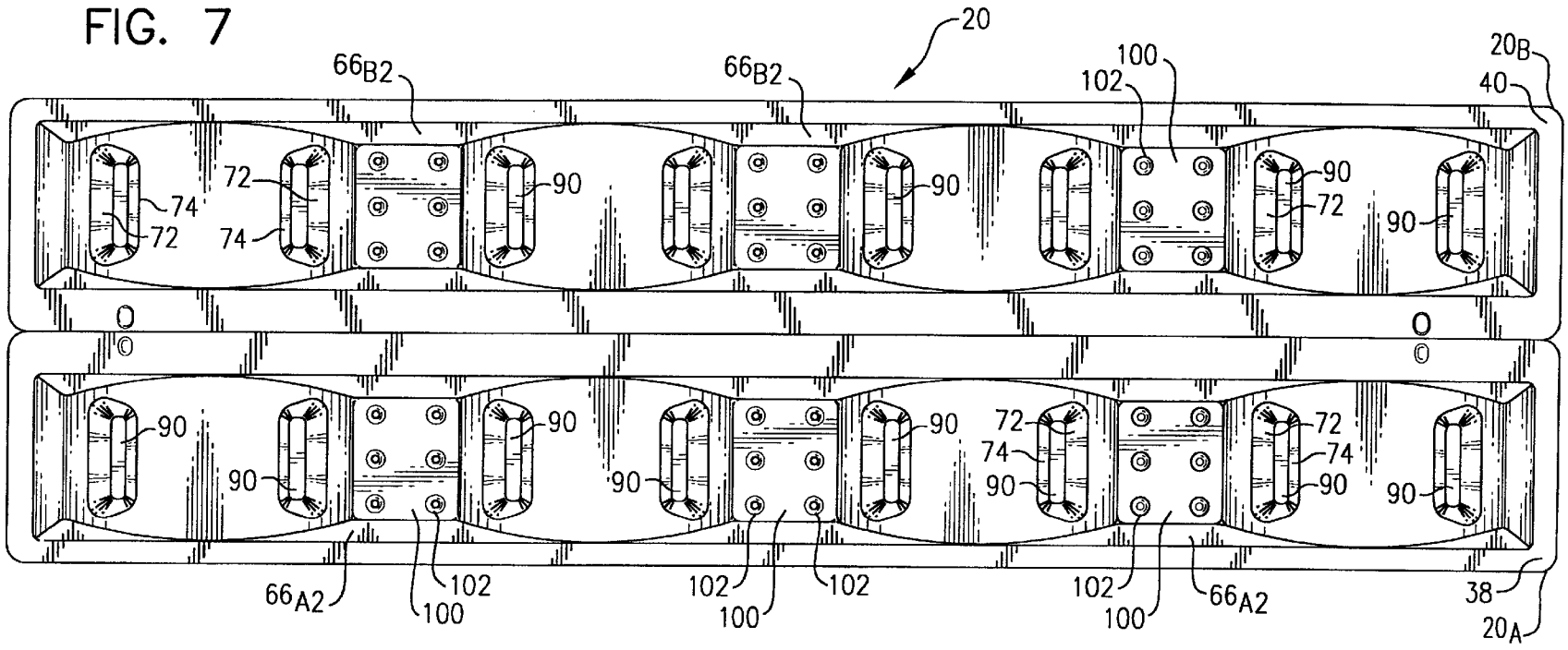
FIG. 7 is a bottom view, taken looking upward at the pair of roll supports first shown in FIG. 5.
Figure 9:
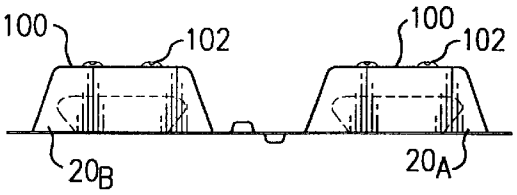
FIG. 9 is a second end view of a pair of roll supports, showing the second end view of the pair of roll supports shown in FIGS. 5, 6, 7, and 8 above.
Figure 10:
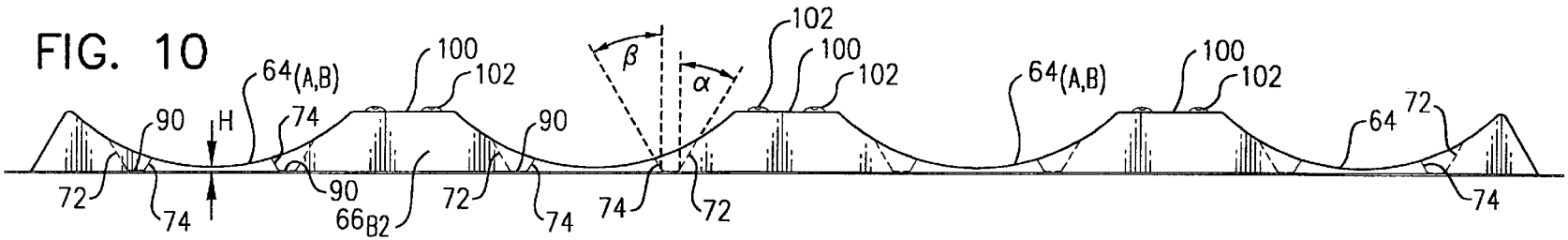
FIG. 10 is side elevation view, taken along one of the opposing sidewalls of a first of a pair of roll supports.
Figure 11:
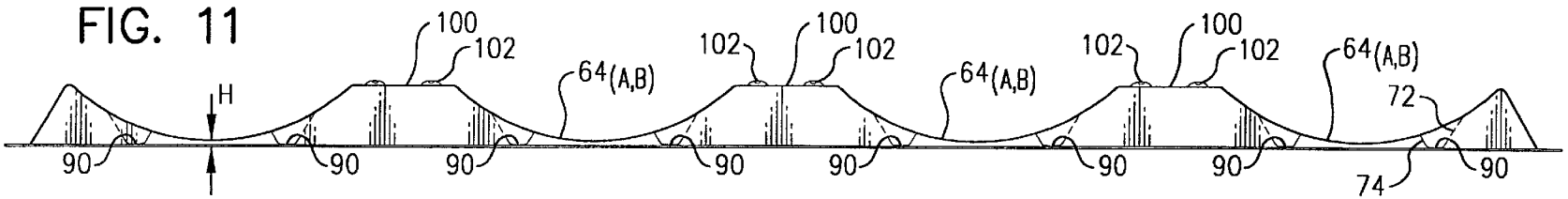
FIG. 11 is a side elevation view, taken along one of the sidewalls of a second one of a pair of roll supports.

To enhance structural strength, one or more support platforms 70 is provided in each of the roll support cradle portions 64A or 64B. Each of the support platforms 70 has first 72 (or long) and second 74 (or short) inwardly and downwardly sloping sidewall portions, each having a lower end portion 76 and 78, respectively (see FIG. 6). Also, the support platforms have opposing end wall portions 80 and 82. A transversely extending bottom support foot 90 is located adjacent the lower end portions 76 and 78 of the first 72 and second 74 inwardly and downwardly sloping sidewall portions. As indicated in FIG. 10, the inwardly sloping sidewall 72 is at an angle alpha ( ) of about 20 degrees from the vertical (or, alternately stated, is at a seventy degree incline). Also as indicated in FIG. 10, the inwardly sloping wall 74 is at an angle beta (β) of about 20 degrees from the vertical (or, alternately stated, is at a seventy degree incline).

The transversely extending bottom support foot 90 extends laterally across the respective roll support cradle portion 64A or 64B. Also, the bottom support foot 90 extends downwardly, when the roll supports are viewed in a side-by-side configuration, to a location substantially even with the height or plane of the respective base 38 or 40. Also, as shown in FIG. 4, when a back-to-back configuration is utilized, the bottom support foot 90 of first roll support portion 20A and the bottom support foot 90 of the second roll support portion 20B are in opposing contact for strong structural support.

As can be seen in various figures, but is most evident in the side view shown in FIG. 10, each of the roll support cradle portions 64A or has a bottom portion, and wherein said bottom portion is elevated above said base. I prefer that the bottom portion 80 of the roll support cradle portion be elevated a height H about 0.25 inches above said base.

Figure 8:
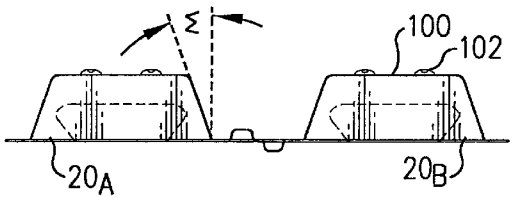
FIG. 8 is first end view of a pair of roll supports, showing the first end view of the pair of roll supports shown in FIGS. 5, 6, and 7 above.

Also, as seen in FIGS. 4 and 8, I prefer that the opposing sidewall portions 66A1, 66A2, 66B1,and 66B2 be angled upward and inward at an angle sigma (ϵ) of about 20 degrees, i.e., to allow a 70 degree slope on the sidewall, when viewed from above.

As shown in the various figures, between adjacent roll support cradle portions, a platform portion 100 is provided. Preferably, a plurality of outwardly and upwardly protruding dimples 102 are located therein, to enhance structural strength.

Figure 12:
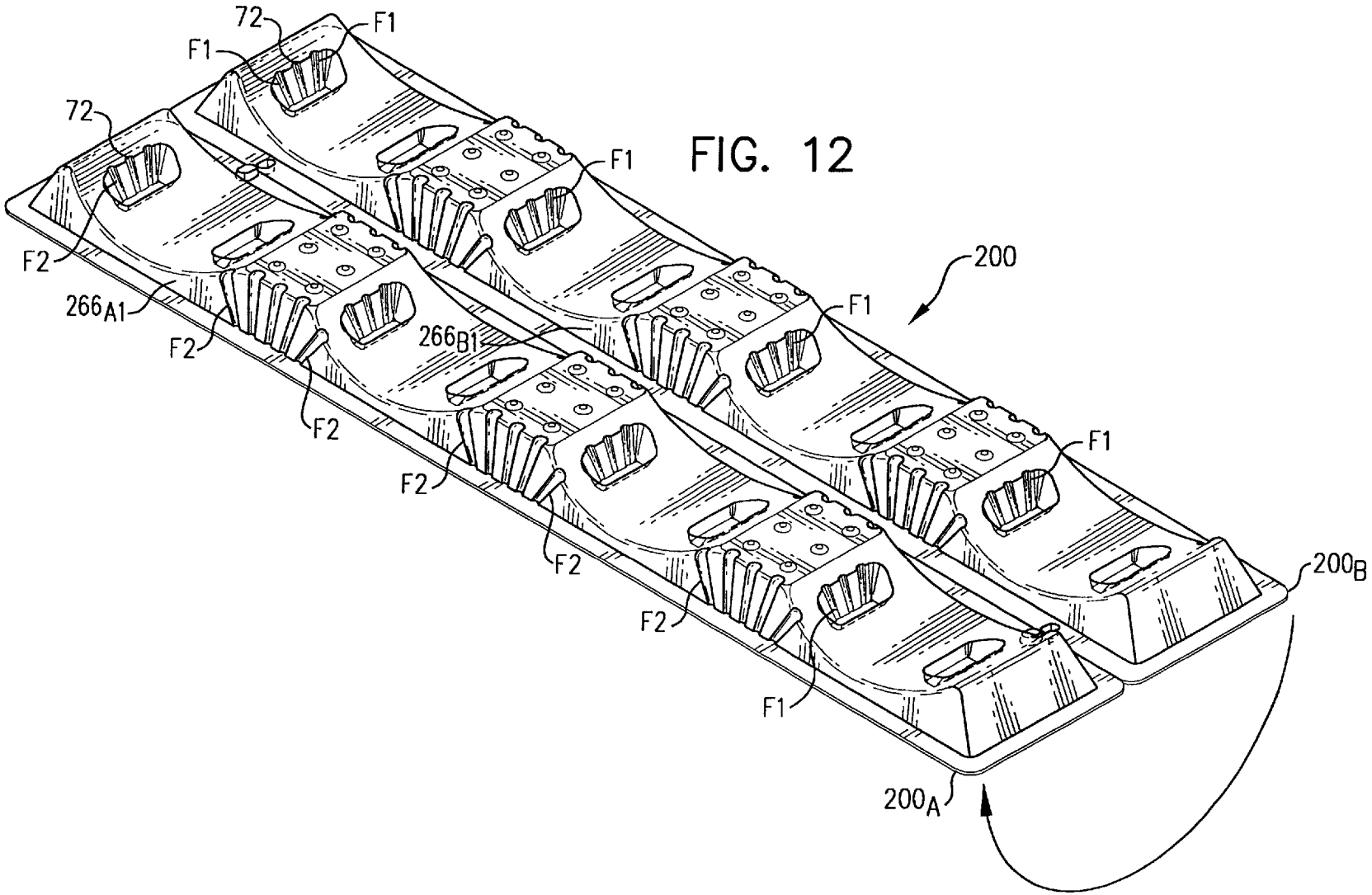
FIG. 12 is a perspective view of a second embodiment of my roll support, showing the pair of roll supports with structurally enhancing flutes in (a) opposing sidewall portions, and (b) in the inward and downward sloping sidewalls of the support platform portion.

Finally, as depicted in FIG. 12, I have developed an enhanced roll support structure 200 which utilizes in each portion 200A and 200B the use of flutes F1 in sidewalls 72 and 74 for enhancing strength in the support portions. Also, flutes F2 have been utilized in opposing sidewalls 266A1 (and opposing sidewall, not shown) and 266B1 (and opposing sidewall, not shown). Ideally, such flutes are up to about 0.25 inches in diameter.

The roll stock 22 supported by my roll supports can be any one of a variety of materials typically wrapped around a spool or core. This rolled material is conventionally placed in the cylindrical or tubular roll for storage, transport and eventual use. The rolled material can be any web material, plastic or film, such as polyethylene or cellophane. As an example, the packaging manufacturing and printing industry employs rolls of plastic film, typically polyethylene, to fabricate bags that receive a printed design or label.

It is also possible to blend the material that forms the roll support 20 of the present invention from other, non-resinous materials, like wood fiber or carbon fiber. These blended or composite materials would be formulated to maintain the thin-walled, thermoformed, advantages as described for the present invention.

The present invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Therefore, the invention is not to be limited except by the following claims, as appropriately interpreted in accordance with the doctrine of equivalents.

I claim:

1. A support apparatus for receiving and supporting one or more pieces of roll stock, said support apparatus comprising:

(a) a first elongated upper surface comprising a plurality of roll support cradle portions, each of said roll support cradle portions having an outward surface shaped in an arcuate segment of pre-selected dimensions adapted for securely receiving a piece of roll stock of substantially complementary shape;

(b) a first pair of longitudinally running opposing sidewall portions, each of said opposing sidewall portions sloping inwardly and upwardly toward said first elongated upper surface;

(c) a first base, said first base providing upward structural support to each of said opposing sidewall portions, which, in turn, each provide upward structural support for said first upper surface comprising a plurality of roll support cradle portions;

(d) one or more support platforms in each of said roll support cradle portions, and wherein each of said one or more support platforms further comprises (i) first and second inwardly and downwardly sloping sidewall portions, each having a lower end portion and (ii) a transversely extending bottom support foot, said bottom support foot located adjacent said lower end portion of said first and said second inwardly and downwardly sloping sidewall portions, and (A) extending laterally across said roll support cradle portion, and (B) extending downwardly to a location substantially even with said first base.

2. The apparatus as set forth in claim 1, wherein each of said roll support cradle portions has a bottom portion, and wherein said bottom portion is elevated above said base.

3. The apparatus as set forth in claim 2, wherein said bottom portion of said roll support cradle portion is elevated about 0.25 inches above said base.

4. The apparatus as set forth in claim 1, wherein each of said opposing sidewall portions is angled upward and inward at an angle sigma ($\epsilon$) of about 20 degrees.

5. The apparatus as set forth in claim 1, wherein each of said first and second inwardly and downwardly sloping sidewall portions of said support platforms is angled downwardly and inwardly at a preselected angle alpha and beta, respectively.

6. The apparatus as set forth in claim 5 wherein said angle alpha ($\alpha$) is about 20 degrees.

7. The apparatus as set forth in claim 5 wherein said angle beta ($\beta$) is about 20 degrees.

8. The apparatus as set forth in claim 1, further comprising, between adjacent roll support cradle portions, a platform portion.

9. The apparatus as set forth in claim 8, wherein said platform portion further comprises a plurality of outwardly and upwardly protruding dimple portions.

10. The apparatus as set forth in claim 1, further comprising:

(a) a second elongated upper surface comprising a plurality of roll support cradle portions, each of said roll support cradle portions having an outward surface shaped in an arcuate segment of pre-selected dimensions adapted for securely receiving a piece of roll stock of substantially complementary shape;

(b) a second pair of longitudinally running opposing sidewall portions, each of said opposing sidewall portions sloping inwardly and upwardly toward said second elongated upper surface;

(c) a second base, said second base providing upward structural support to each of said second pair of opposing sidewall portions, which, in turn, each provide upward structural support for said second upper surface comprising a plurality of roll support cradle portions;

(d) a flexible attachment portion, said flexible attachment portion adapted to flexibly connect said first base to said second base so that said first (e) one or more support platforms in each of said roll support cradle portions, and wherein each of said one or more support platforms further comprises (i) first and second inwardly and downwardly sloping sidewall portions, each having a lower end portion and (ii) a transversely extending bottom support foot, said bottom support foot located adjacent said lower end portion of said first and said second inwardly and downwardly sloping sidewall portions, and (A) extending laterally across said roll support cradle portion, and (B) extending downwardly to a location substantially even with said first base.

11. The apparatus as set forth in claim 1, or in claim 10, wherein said apparatus in manufactured in a strong, flexible plastic material.

12. The apparatus as set forth in claim 11, wherein the plastic material is a polyethylene terephthalate.

13. The apparatus of claim 12, wherein said plastic material is a recycled plastic, material.

14. The apparatus as set forth in claim 11, wherein said apparatus is thermoformed.

15. The apparatus as set forth in claim 10, wherein a multiple of roll supports combine to support a multiple of rolls of roll stock, said rolls of roll stock supported by the roll supports to form a bottom tier of supported roll stock, and the bottom tier of the supported roll stock additionally supports a minimum of two additional tiers of the roll stock, and each of the two additional tiers of the cylindrical is also supported by additional roll supports.

* * * * *